US009993376B1

(12) United States Patent
Akers, Jr.

(10) Patent No.: US 9,993,376 B1
(45) **Date of Patent: *Jun. 12, 2018**

(54) POWER LIFT

(71) Applicant: Uriah S. Akers, Jr., True, WV (US)

(72) Inventor: Uriah S. Akers, Jr., True, WV (US)

(73) Assignee: Austin Lulit Lift Systems, Inc., Princeton, WV (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/402,227

(22) Filed: Jan. 9, 2017

Related U.S. Application Data

(62) Division of application No. 14/539,989, filed on Nov. 12, 2014, now Pat. No. 9,545,345.

(51) Int. Cl.
*A61G 3/02* (2006.01)
*A61G 3/06* (2006.01)
*A61G 1/02* (2006.01)

(52) U.S. Cl.
CPC ..... *A61G 3/062* (2013.01); *A61G 1/02* (2013.01); *A61G 3/029* (2013.01); *A61G 3/0236* (2013.01); *A61G 3/0254* (2013.01); *A61G 3/061* (2013.01)

(58) Field of Classification Search
CPC .. A61G 3/0272; A61G 3/0236; A61G 3/0245; A61G 3/029; A61G 3/0891; A61G 3/0825; A61G 3/0254; A61G 3/2063
See application file for complete search history.

(56) References Cited

U.S. PATENT DOCUMENTS 5,738,306 A * 4/1998 Moss ..... B64D 9/00 244/118.6
6,332,638 B1 * 12/2001 Menna ..... A61G 1/0565 296/20
6,726,435 B1 * 4/2004 Williams ..... B60P 1/4442 414/497
8,113,760 B1 * 2/2012 Schroll ..... A61G 3/06 414/522
8,439,416 B2 * 5/2013 Lambarth ..... A61G 1/02 296/20
8,444,195 B2 * 5/2013 Bourgraf ..... B60P 1/003 296/20
8,714,504 B2 * 5/2014 Vuorenoja ..... A61G 1/06 248/285.1
8,820,812 B2 * 9/2014 Menna ..... A61G 3/0245 296/19
9,017,003 B2 * 4/2015 Nims ..... A61G 3/0236 414/479

(Continued)

FOREIGN PATENT DOCUMENTS

DE 1285673 B * 12/1968 ..... A61G 3/0236
DE 2343572 B1 * 12/1974 ..... A61G 3/0236

(Continued)

*Primary Examiner* — Kaitlin S Joerger
(74) *Attorney, Agent, or Firm* — Johnston Holroyd; Mary-Jacq Holroyd

(57) ABSTRACT

A deployable gurney ramp assembly with a retractable ramp deployment apparatus having two deployment tracks extending parallel, parallel first and second base tracks terminating in stops, the deployment tracks slidably engage the base tracks, with ramp guides slidably pivotally engaging a ramp at the end permitting the ramp to pivot when raised or lowered. Extension devices are utilized to advance the deployment ramps and the ramp guides.

20 Claims, 12 Drawing Sheets

(56) References Cited

U.S. PATENT DOCUMENTS

| | | | | |
|---|---|---|---|---|
| 2007/0224024 | A1* | 9/2007 | Yang | B60P 1/003 414/522 |
| 2010/0329831 | A1* | 12/2010 | Tornese | B60P 1/4435 414/544 |
| 2012/0237326 | A1* | 9/2012 | Van Ness | A61G 3/0236 414/507 |

FOREIGN PATENT DOCUMENTS

| | | | | |
|---|---|---|---|---|
| DE | 19607899 | A1 * | 9/1997 | A61G 1/06 |
| DE | 102008005900 | A1 * | 7/2009 | A61G 1/0562 |
| EP | 2366369 | A2 * | 9/2011 | A61G 3/02 |
| WO | WO 2010145691 | A1 * | 12/2010 | A61G 3/0236 |

* cited by examiner

POWER LIFT

RELATED APPLICATIONS

This application claims the benefit of U.S. Pat. No. 9,545,345 entitled "Power Lift", filed on 12 Nov. 2014 and issued on 17 Jan. 2017, which claimed the benefit of U.S. Provisional Application Ser. No. 61/902,764, filed on 11 Nov. 2013 (Veteran's Day), the contents of both of which are incorporated herein by reference in their entirety.

BACKGROUND OF THE INVENTION

The transportation of patients to and from ambulances is known. Frequently, the transportation of patients from a level curbside or flat ground into, and out of, an emergency vehicle is not possible. Patients are often transported from an emergency or rural location where there are no curbs or even road access. Under both circumstances, patients must be lifted into a transport vehicle typically using a gurney and then loaded into the transport vehicle.

Injuries for emergency personnel transporting patients are common. Back injuries and muscle strains resulting from lifting patients and gurneys are common ailments. Uneven or rough terrains make injuries even more likely. The same is true for helicopter transportation, as well.

There exists a need for patient vehicle loading and unloading in which emergency personnel have a minimum need to physical lift or move the patient into or out of the emergency transport vehicle, such as an ambulance or helicopter.

SUMMARY OF THE INVENTION

The present invention transport vehicle supported power lift for lifting patient laden gurney into a transport vehicle. The present design is especially adapted to lifting a patient on a gurney into a transport vehicle whether ambulance, helicopter, or the like, and from uneven ground.

The invention may utilize a push button actuation, or a single actuator per stage, and is fully automated so that no other lifting force is required. The actuator or button actuation may be carried out using wireless technology including actuation by handheld devices. Alternatively, permanently mounted devices or the like may be used, which may be hardwired, or wirelessly actuated.

The present design allows the lifting of off center or angled gurneys that are not lined up on even curbsides.

An aspect of the present design is that it protects the operator by not requiring the lifting or pushing required in lifting and lowering most gurneys. The gurney becomes permanently locked into place by a mechanical or magnetic lock. In an embodiment, four such locks are used to secure the gurney to the ramp, but other configurations for securing the gurney are optional including the use of more or fewer locks.

Another aspect of the present design is that it operates with the use of a series of actuators operated by the touch of a button, or equivalent input device. The actuators deploy to bring ramp out of truck, raise and lower ramp, and raise and lower for the gurney.

A further aspect of the present design is that it can be used on uneven ground where the ground is slanting in any direction as is common in mountainous regions.

Yet another aspect of the present design is that it retracts or folds up and stows out of the way.

These and other aspects of the present invention will become readily apparent upon further review of the following drawings and specification.

BRIEF DESCRIPTION OF THE DRAWINGS

The novel features of the described embodiments are specifically set forth in the appended claims; however, embodiments relating to the structure and process of making the present invention, may best be understood with reference to the following description and accompanying drawings.

Similar reference characters denote corresponding features consistently throughout the attached drawings.

DETAILED DESCRIPTION OF PREFERRED EMBODIMENTS

Figures 1A, 1B, 1C:
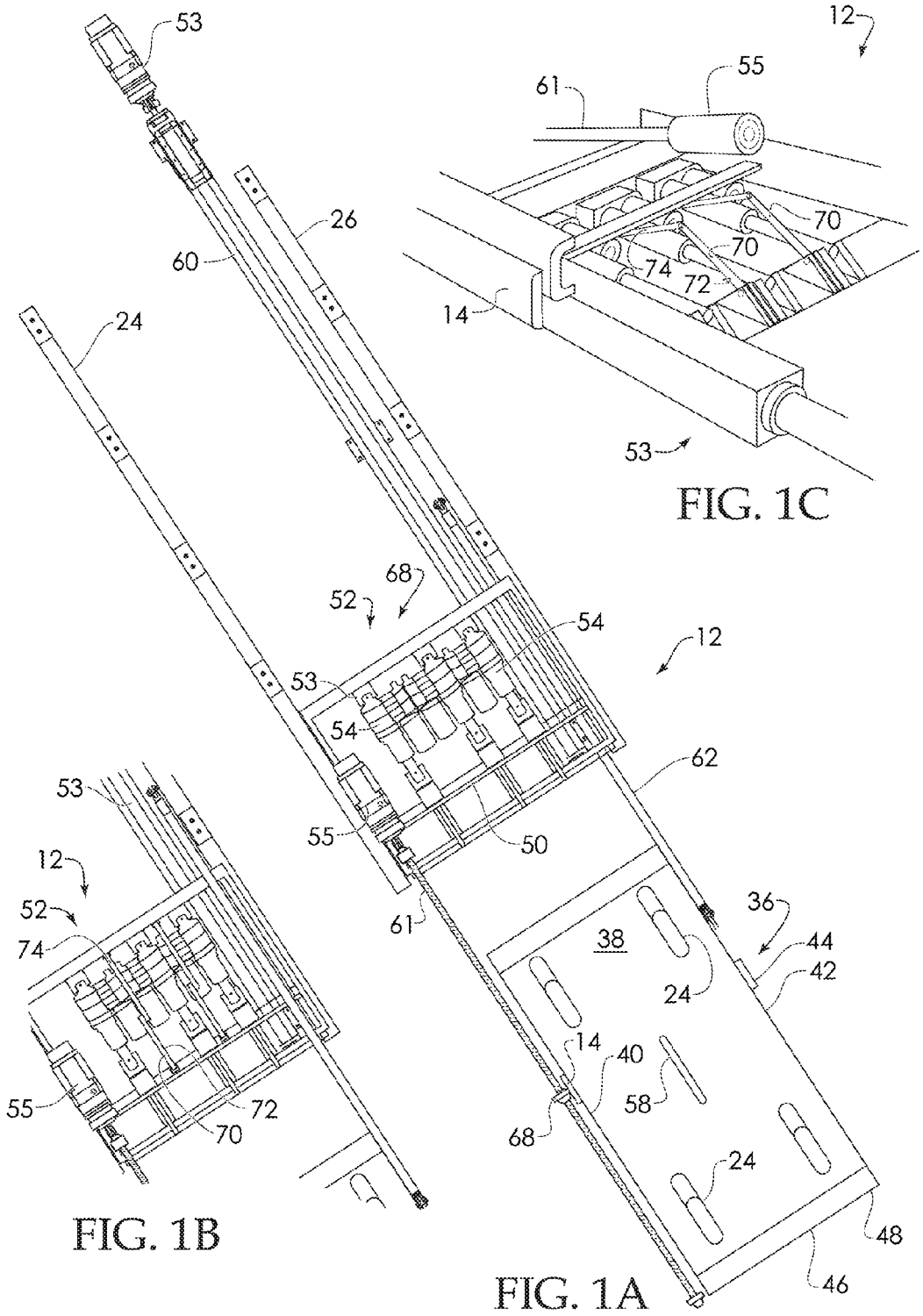
FIGS. 1A-1C show the actuation mechanisms of a deployable gurney ramp assembly according to alternative embodiments of the present design.

The alternative actuation mechanisms of a deployable gurney ramp assembly 12 according to various embodiments of the present design are shown in FIGS. 1A-1C. FIG. 1A is a top plan view of an actuation mechanism including first and second screws 60 and 61, three telescoping rams 54, and a guide rod 62. The second screw 61 operates to retract and extend the retractable ramp 36 from the retractable ramp assembly 14 and is disposed to tilt and lower the retractable ramp 36 into position. The guide rod 62 simply maintains the retractable ramp 36 in a horizontal position during lifting and lowering. The first screw 60 operates to extend the retractable ramp assembly 14 from the bed of an ambulance A. The first screw 60 may be actuated mechanical, hydraulically, or pneumatically, and where electricity is utilized in the operation either AC or DC may be utilized. The second screw 61 may be replaced with alternative mechanical, hydraulic, or pneumatic mechanisms to retract and extend the retractable ramp assembly horizontally.

The materials include steel, aluminum, titanium, and alloys thereof, and composite materials, and combinations thereof. The work performed by the force of electricity, pneumatics, or hydraulics, and combinations thereof. Mechanical, pneumatic, and/or hydraulic actuation may be used. Electric motors may be driven using alternating current or direct current, or combinations thereof.

The mechanism to lower the retractable ramp shown in FIG. 1A is depicted using three telescoping rams 54 which are pivotally engaged along an axis 53 at the front (towards the cab of the ambulance when installed) and fixed towards the rear to a cross beam 50. Although three telescoping rams 54 are depicted in the figures, more rams or fewer may be used. The lowering mechanism of FIGS. 1B and 1C has an additional component, which is a cantilever arm 70 that provides additional support which has first and second lengths of metal 72 and 74 attached along the axis 53 of the rams 54 at the front, and on the beam 50 towards the rear.

Figure 2A:
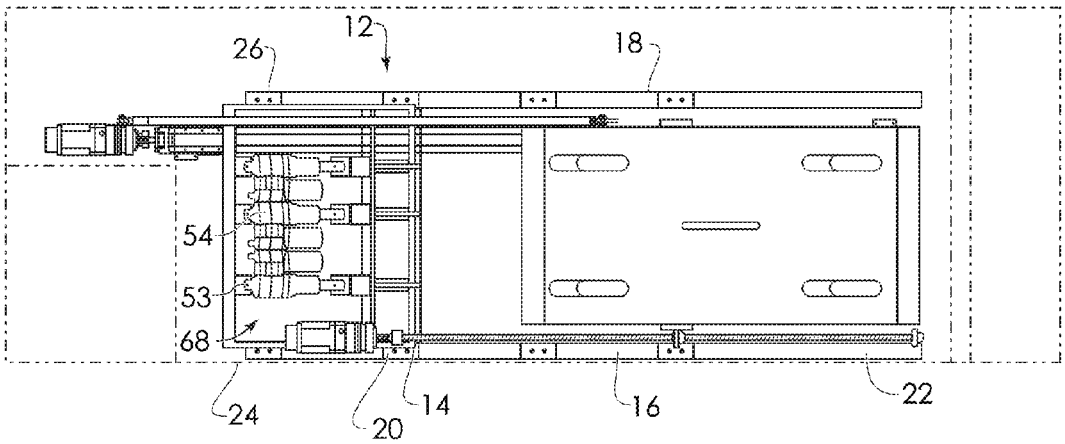
FIGS. 2A-2C show a deployable gurney ramp assembly according to the embodiment of FIG. 1A with the assembly fully withdrawn into an ambulance depicted in dashed lines.
Figure 2B:
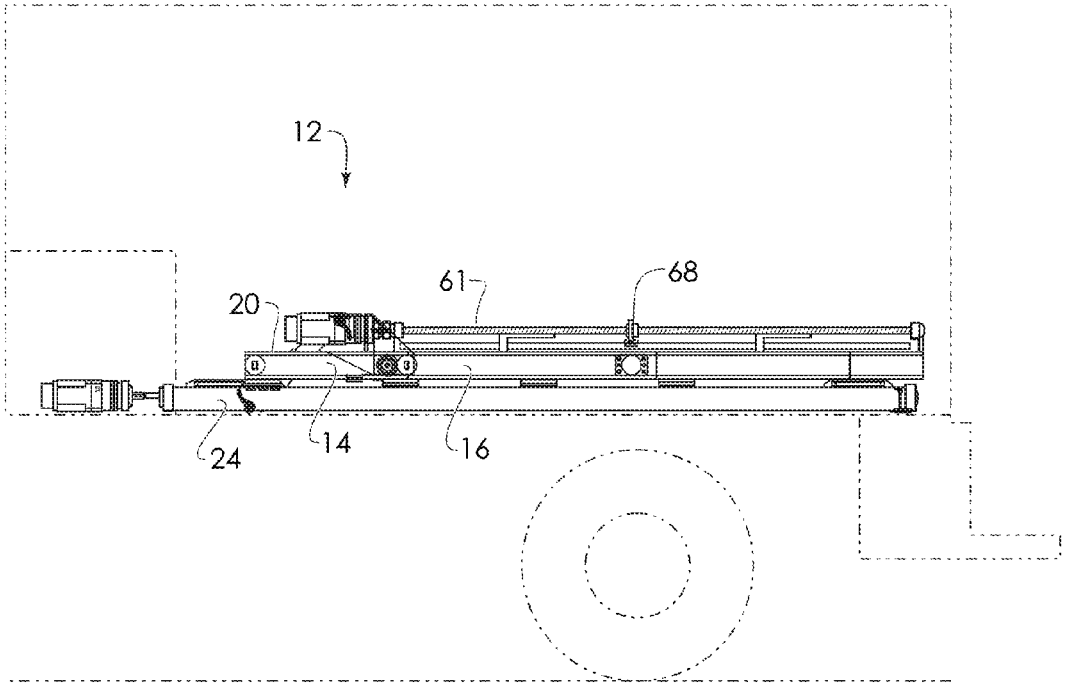
Figure 2C:
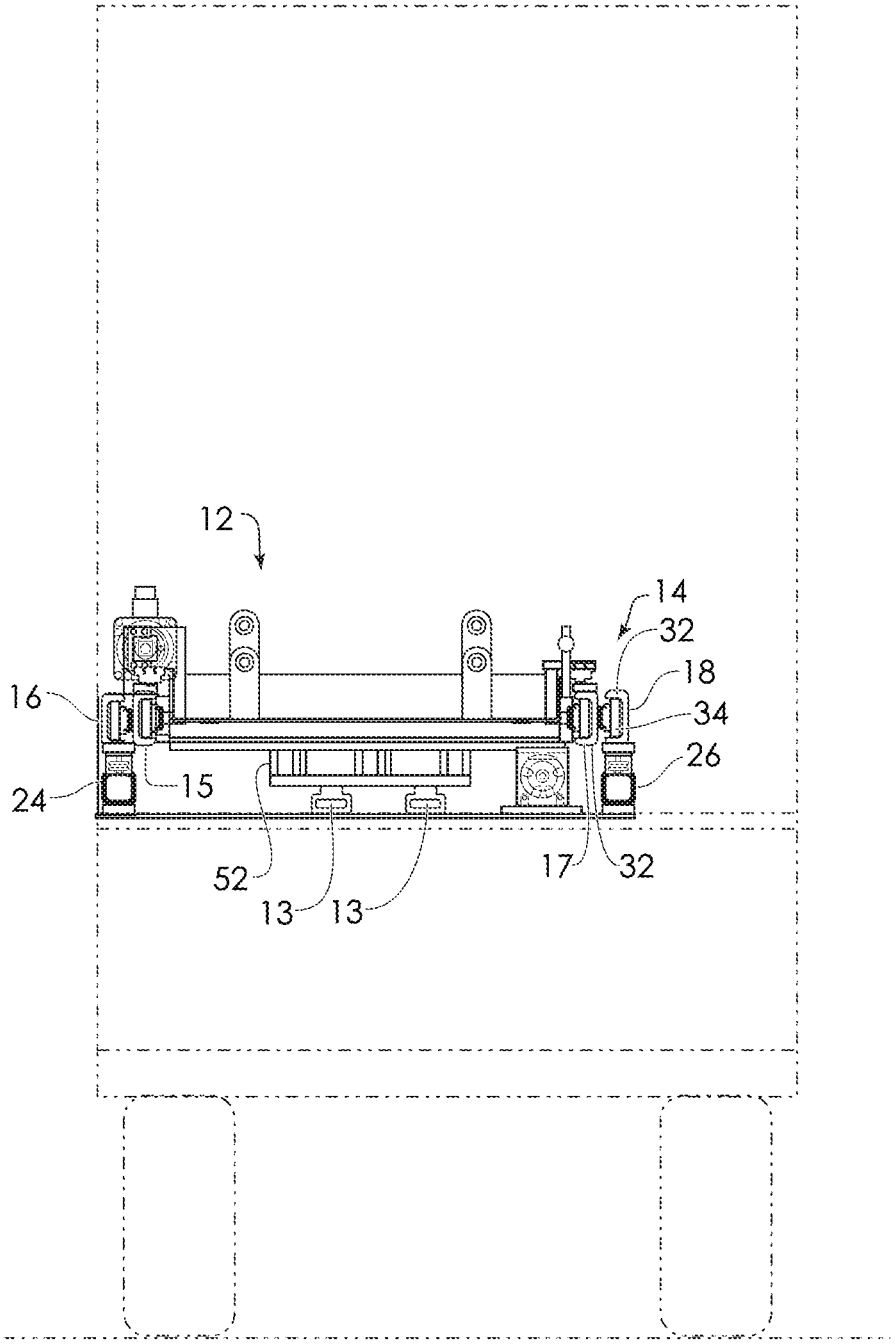

FIGS. 2A-2C show a deployable gurney ramp assembly 12 according to the embodiment of FIG. 1A, which does not show the cantilever arms 70. A containment cover 73 which covers the retractable ramp deployment apparatus 14 and base 24 and 26 is not shown for clarity sake. The deployable ramp assembly 12 is fully withdrawn into the ambulance depicted in dashed lines. FIG. 2A shows a top view of the deployable gurney ramp assembly 12 and demonstrates the retracted position. FIG. 2B is a side view of the retracted ramp assembly 12. FIG. 2C shows a detailed view of the end of the gurney ramp assembly 12 showing the two deployable sets of tracks 16 and 18 in which the base tracks 24 and 26 are depicted engaging the parallel tracks 15 and 17 of the retractable ramp deployment apparatus 14, and a set of guides 13 for slidably supporting the lift actuators 52 to assure precision movement thereof.

Figure 3A:
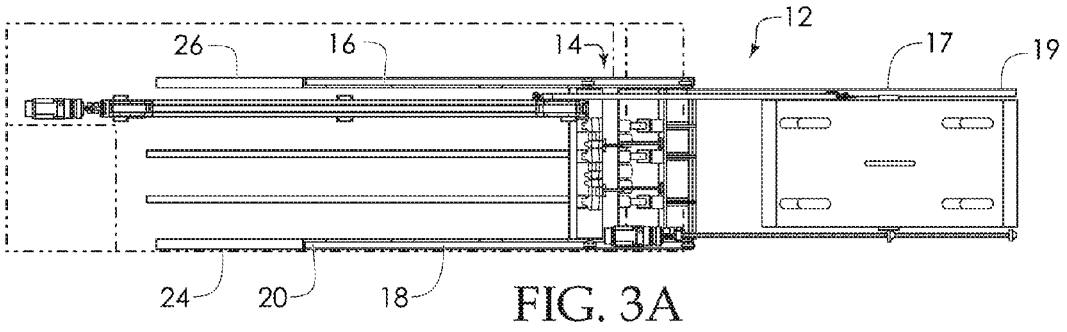
FIGS. 3A-3C show a deployable gurney ramp assembly according to the embodiment of FIG. 1A with the assembly partially deployed from the ambulance.
Figure 3B:
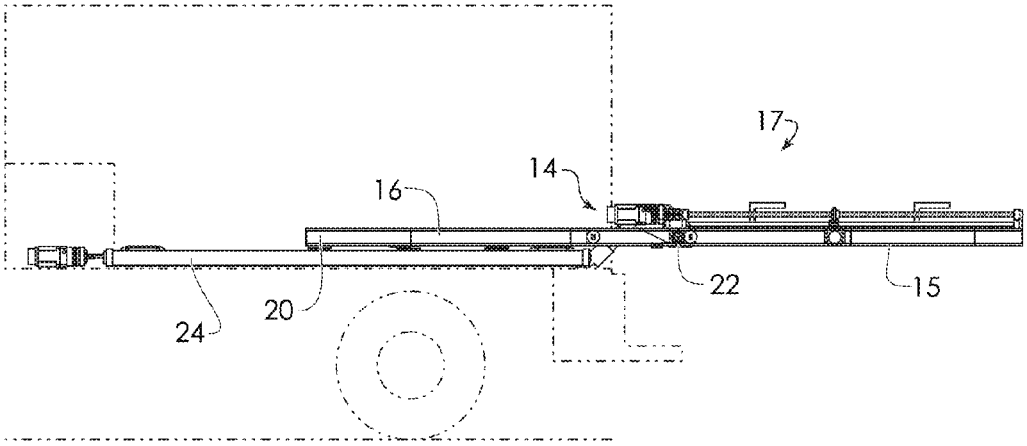
Figure 3C:
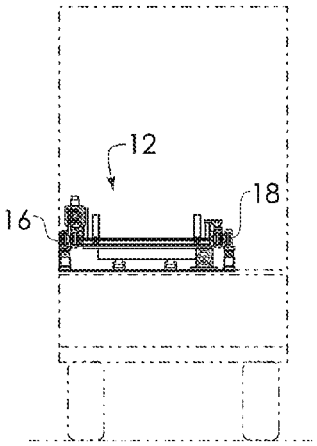

A partially deployed deployable gurney ramp 36 assembly is shown in FIGS. 3A-3C. FIG. 3A shows a top view of the base tracks 24 and 26, actuation mechanisms, retractable ramp deployment apparatus tracks 18 (track 16 is not shown in FIG. 3A), and ramp 36 extending from the back of the ambulance A. FIG. 3B shows a side view depicting two layers of tracks, the base tracks 24 and 26 and the retractable tracks 16 and 18, 15 and 17 with the ramp 36 deployed at the end thereof. FIG. 3C demonstrates that the same track arrangement pattern is seen in FIG. 2C on end.

Figure 4A:
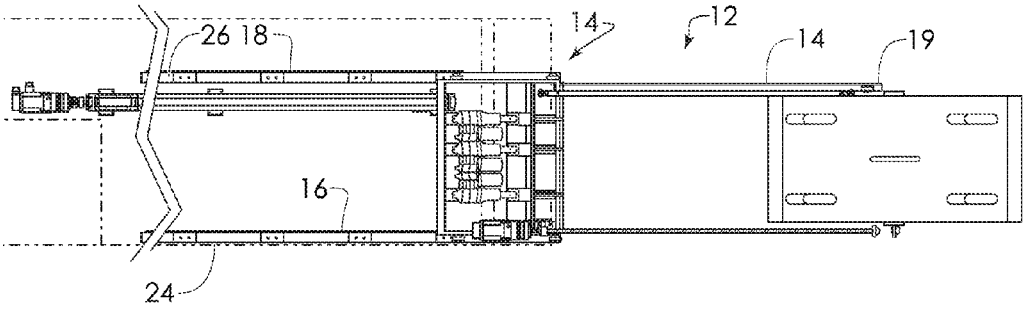
FIGS. 4A-4C show a deployable gurney ramp assembly according to the embodiment of FIG. 1A with the assembly fully deployed from the ambulance with the retractable ramp in the maximum horizontal extension from the tracks.
Figure 4B:
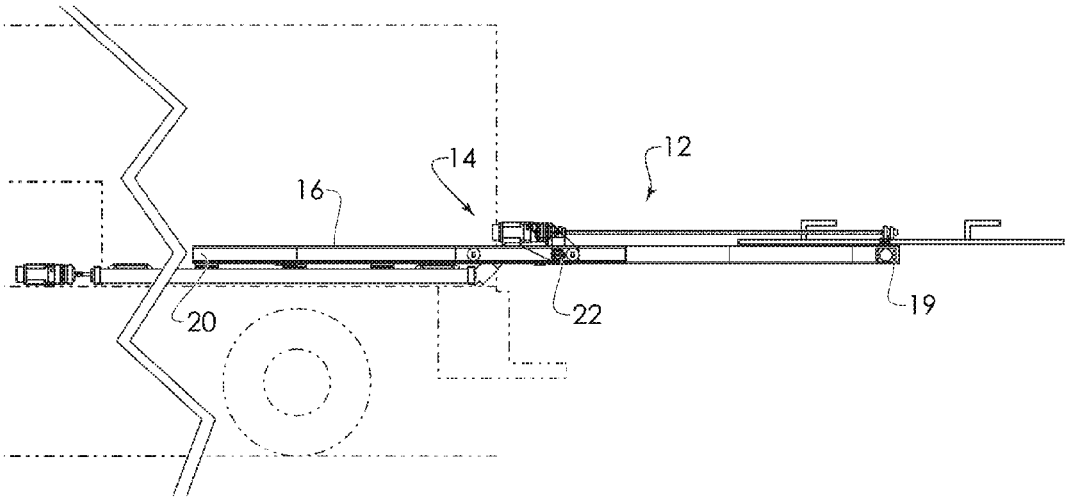
Figure 4C:
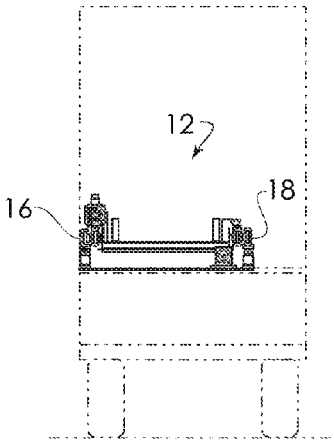

Similarly, FIGS. 4A-4C show a deployable gurney ramp assembly 12 except that the assembly 12 is fully deployed horizontally with the retractable ramp 36 extending outward most from the tracks. FIG. 4A shows the full horizontal expansion with the ramp 36 completely extended at the end of the retractable tracks. The ramp 36 is pivotally disposed between the ends of the ramp tracks 15 and 17. FIG. 4C demonstrates that again from the end, the arrangement appears the same as FIGS. 2C and 3C, although the guides are not shown in FIG. 4C. The tracks are lined up for the entire length of the horizontal stroke.

Figure 5A:
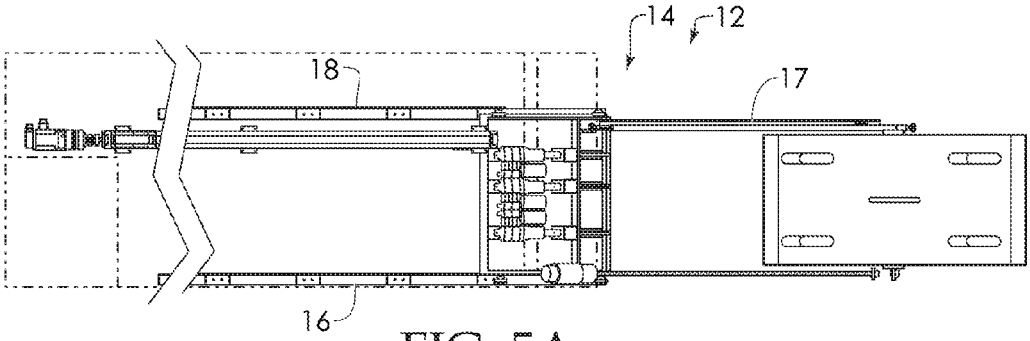
FIG. 5A-5C show a deployable gurney ramp assembly according to the embodiment of FIG. 1A with the retractable ramp lowered to the ground in position for a gurney to be placed upon the ramp.
Figure 5B:
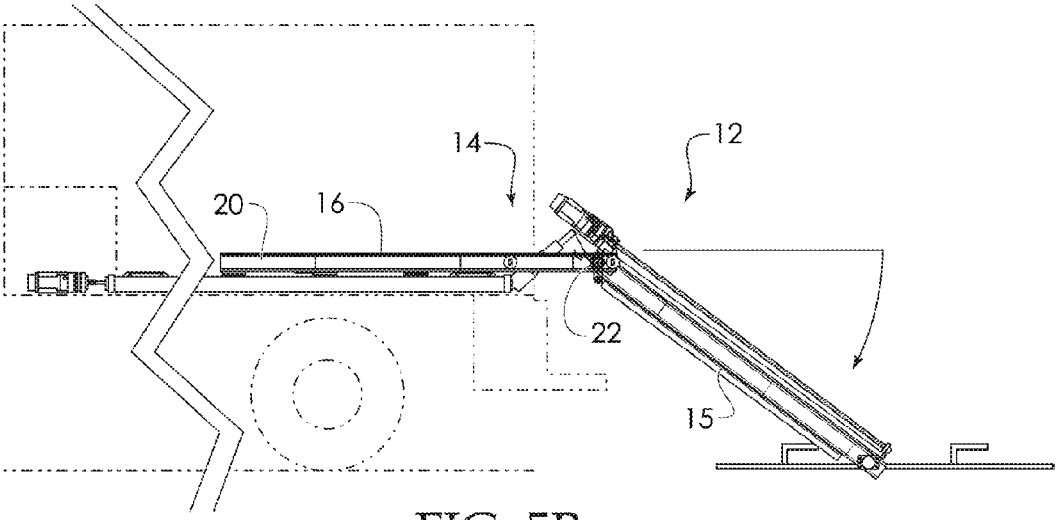
Figure 5C:
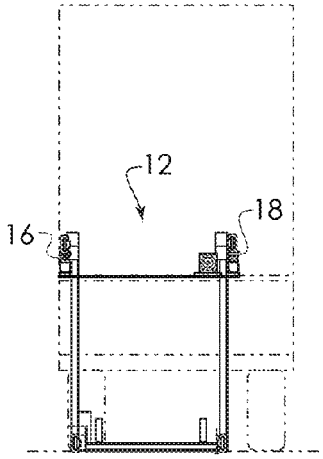

FIGS. 5A-5C show a deployable gurney ramp assembly 12 with the retractable ramp lowered to the ground in position for a gurney to be placed upon the ramp. FIG. 5A is a top view of the lowered ramp 36. FIG. 5B shows a side view with the ramp 36 lowered and demonstrates that the telescoping ram provides control when the ramp 36 is lowered from a fully extended horizontal position. FIG. 5C is an end view with the ramp 36 lowered on even ground.

Figure 6A:
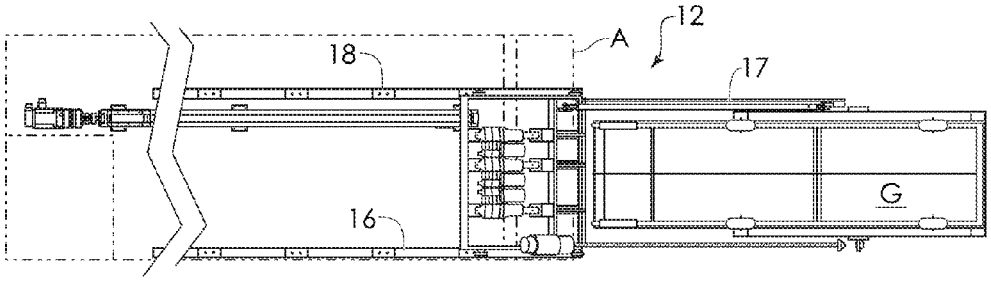
FIGS. 6A-6C show the deployed gurney ramp assembly of FIGS. 5A-5C with an upright gurney disposed on the retractable ramp.
Figure 6B:
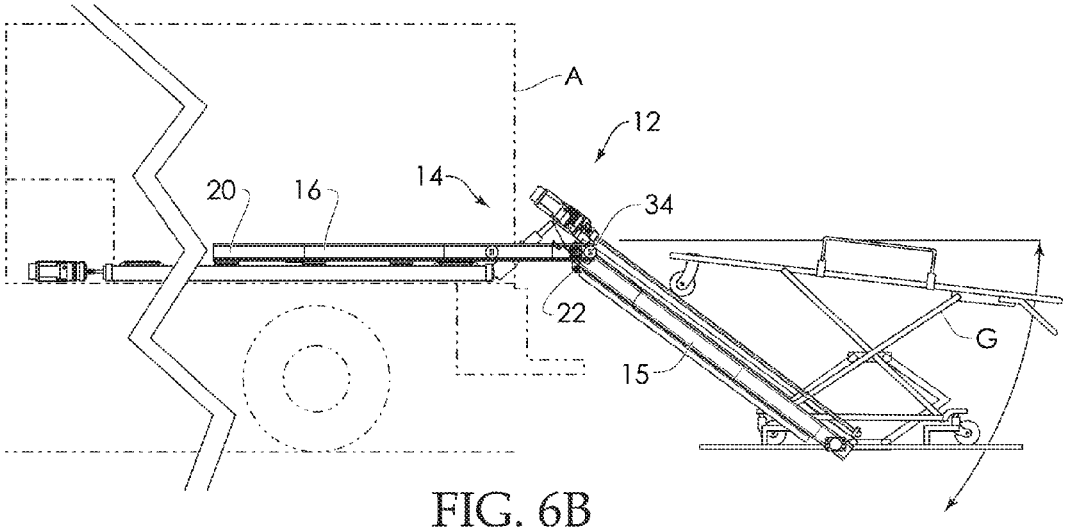
Figure 6C:
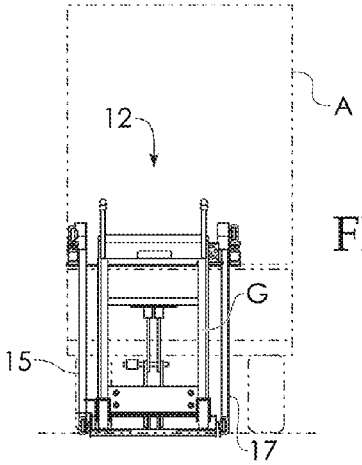

FIGS. 6A-6C show the deployed gurney ramp 36 with an upright gurney G disposed on the retractable ramp 36. A gurney lowering device 58 is provided on the ramp 36 which may aid in lowering the gurney G in a manner similar to a toggle jack, although a scissor jack configuration would work as well. The device alternatively uses manual, pneumatic, or hydraulic actuation, or combinations thereof. Gurney positioning guides or retainers may also be disposed to assure proper placement of the gurney for secure lifting. Magnetic locks, preferably at four points, may be utilized to securely fix a gurney to the ramp for transportation to protect against a side impact or rollover in the event of an accident. FIG. 6A shows a top view, FIG. 6B is a side view, and FIG. 6C is an end view. The gurney lowering device can be seen in FIGS. 6B and 6C. A magnetic mechanism or mechanical lever may be provided to actuate the gurney remotely or automatically to initiate lowering of the gurney without requiring anyone to physically lower the gurney. The gurney then rides down on the gurney lowering device.

Figure 7A:
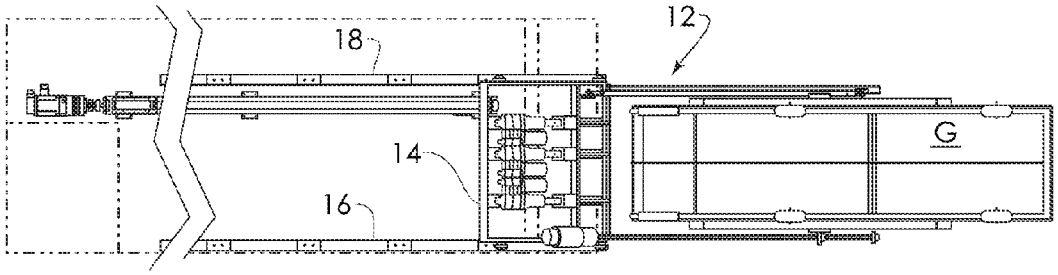
FIG. 7A-7C show the deployed gurney ramp assembly of FIGS. 5A-5C with the gurney lowered onto the retractable ramp.
Figure 7B:
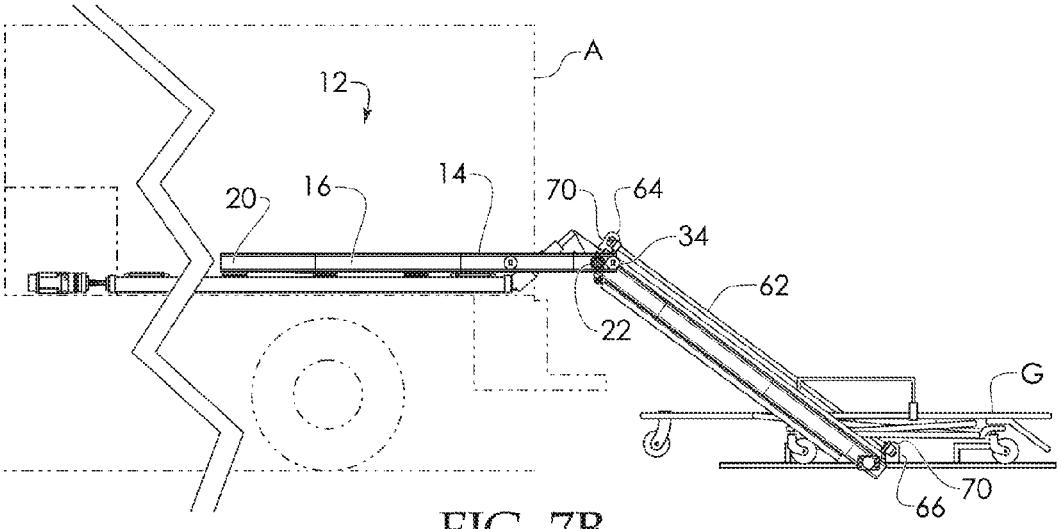
Figure 7C:
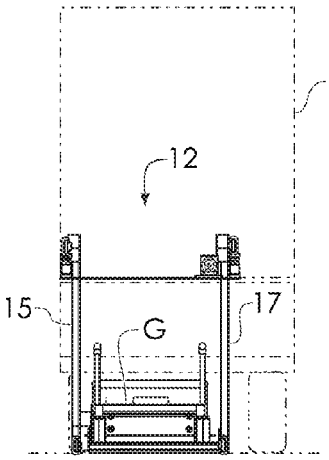
Figure 8A:
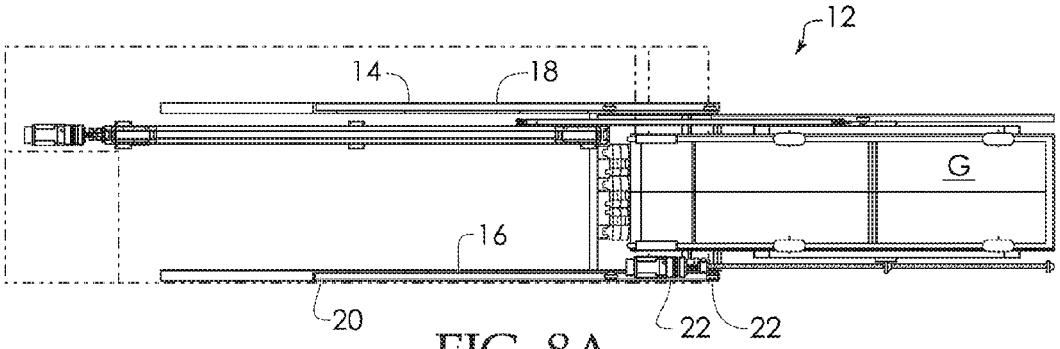
FIG. 8A-8C show the retracting gurney ramp with the lowered gurney thereon.
Figure 8B:
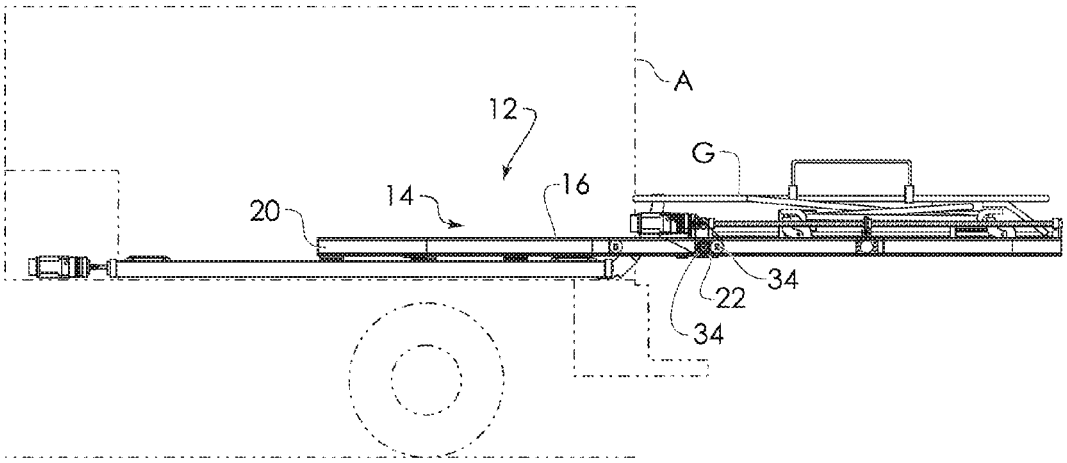
Figure 8C:
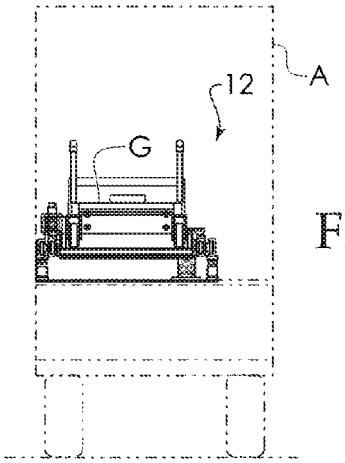

The deployed gurney ramp assembly 12 shown in FIGS. 7A-7C has the gurney lowered onto the retractable ramp 36, while FIGS. 8A-8C show the retracting gurney ramp with the lowered gurney thereon. The next four images, FIGS. 9-12, show the positions of the lowered gurney being lifted to horizontal position and being retracted into the ambulance. The entire device makes a very small foot print on, in, or partially under the floor of the ambulance. The containment cover 73 is shown in FIGS. 9-12.

Figure 9:
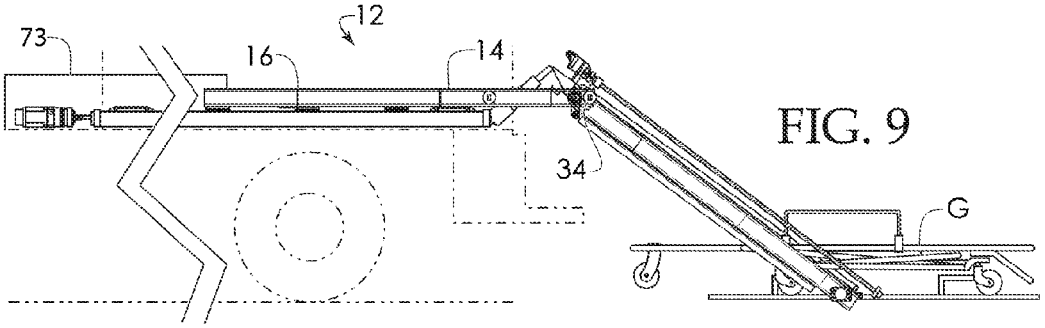
FIG. 9 shows the retracting gurney ramp with the lowered gurney at the down position.
Figure 10:
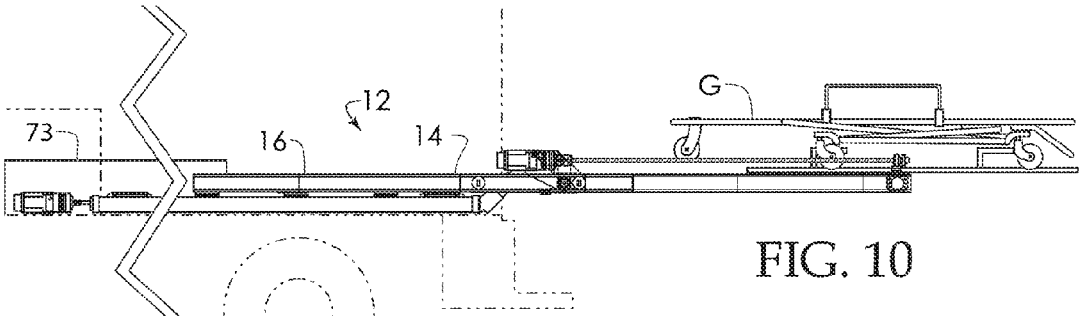
FIG. 10 shows the retracting gurney ramp with the lowered gurney at the up fully extended position.
Figure 11:
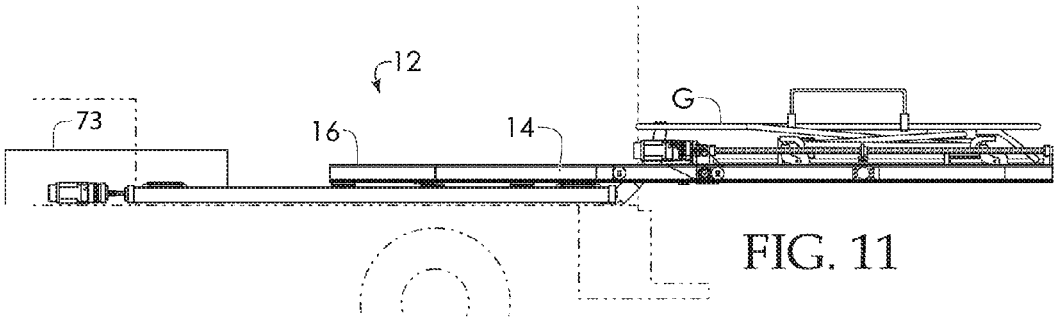
FIG. 11 shows the retracting gurney ramp with the lowered gurney at the first intermediately retracted position.
Figure 12:
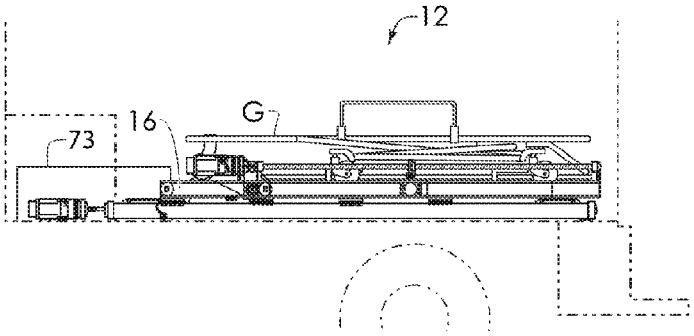
FIG. 12 shows the retracting gurney ramp with the lowered gurney in the completely retracted position.

FIG. 9 shows the retracting gurney ramp 36 with the lowered gurney G at the down position. FIG. 10 shows the retracting gurney ramp 36 with the lowered gurney at the up fully extended position. FIG. 11 shows the retracting gurney ramp 36 with the lowered gurney at the first intermediately retracted position. FIG. 12 shows the retracting gurney ramp 36 with the lowered gurney in the completely retracted position. The containment cover 73 is shown in FIGS. 9-12, and serves as a useful surface, such as a floor of the ambulance. In practice, the ramp 36 acts as a cover over the rearward of the apparatus, which is not drawn to scale.

Figure 13A:
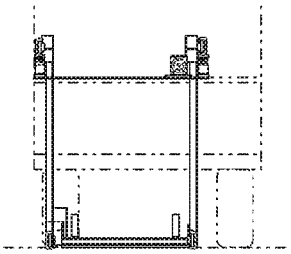
FIGS. 13A-13C show end thumbnail views of the gurney ramp demonstrating its usefulness on uneven grounds.
Figure 13B:
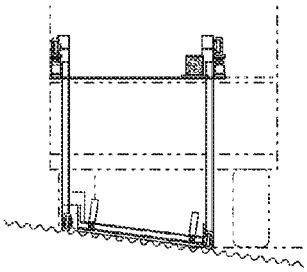
Figure 13C:
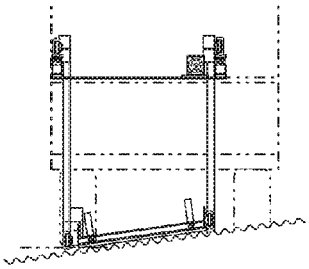
Figure 14A:
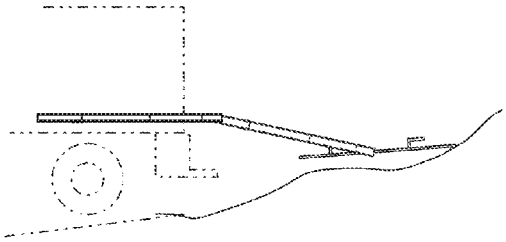
FIG. 14A-14B show side thumbnail views of the gurney ramp demonstrating its usefulness on uneven grounds.
Figure 14B:
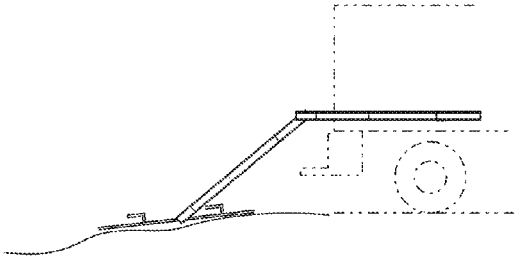

The present ramp assembly 12 may be used on uneven ground. The ramp 36 may be disposed on uneven ground, and will adjust within a range to the slope of the ground. Slopping to the side are shown in FIGS. 13A-13C, which provide thumbnail views of the end of the gurney ramp 36. FIG. 13A demonstrates use on a flat surface. FIG. 13B shows the uneven ground sloping in one direction while FIG. 13C show is sloping in the opposite direction. Sometimes the ground rises or falls away from the end of the ambulance. This scenario is demonstrated in FIGS. 14A-14B and shows the angles that the device may be used.

Figure 15A:
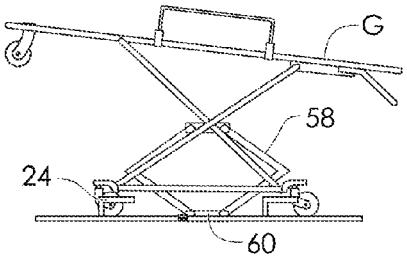
FIGS. 15A-15C show the mechanism for assisted automatic lowering of the gurney, and the lock mechanism.
Figure 15B:
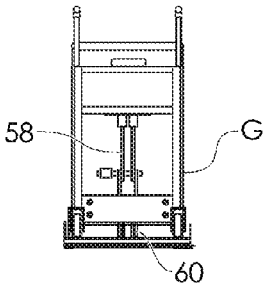
Figure 15C:
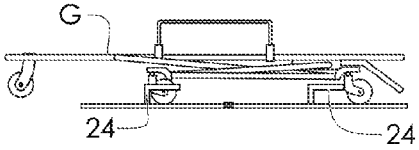

The ramp 36 may have a gurney lowering device 58, which is demonstrated in FIGS. 15A-15B. The mechanism for assisted automatic lowering of the gurney engages the undercarriage of a gurney. Upon actuation of the lowering mechanism of an automated gurney, or activating a gurney lowering mechanism, the lowering device 58 gently lowers the gurney without requiring the operator to lower the gurney manually. An automated magnetic actuator may be provided on the lowering mechanism in order to actuate an automated gurney to lower. FIG. 15C shows the gurney in the lower position with locking guides 24 at about the wheels.

Figure 16A:
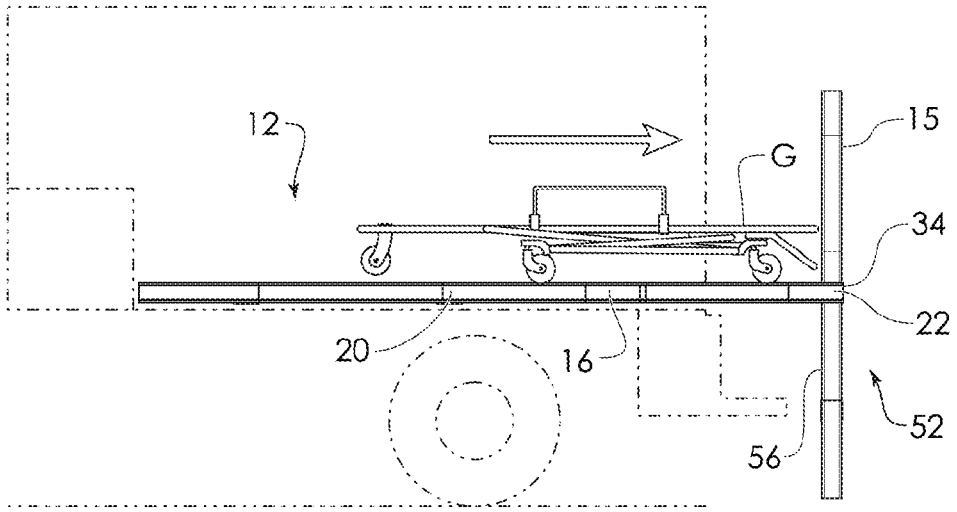
FIGS. 16A-16B show an alternative lowering mechanism for the gurney that operates vertically.
Figure 16B:
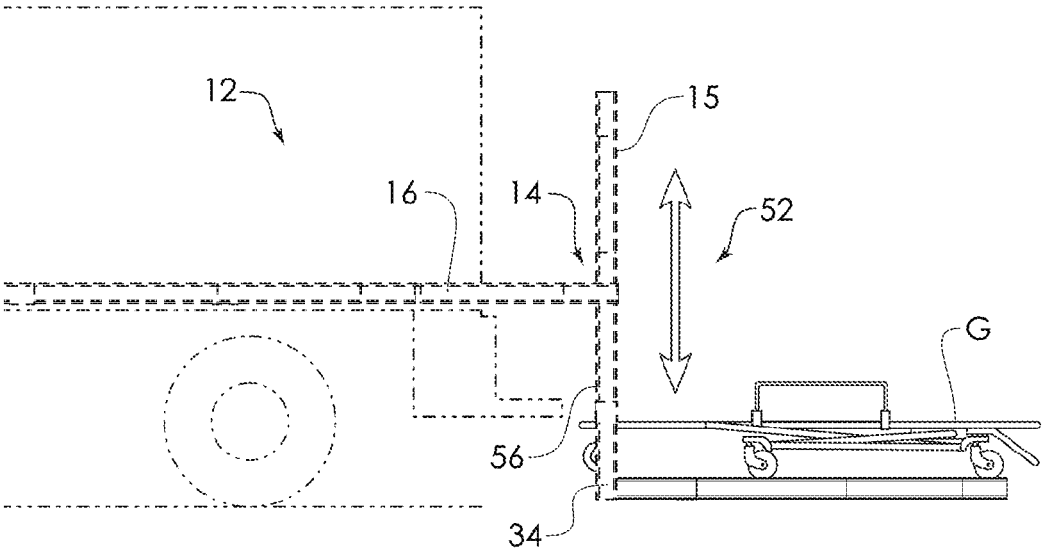

FIGS. 16A-16B show an alternative lowering mechanism for the gurney that operates vertically. In this embodiment, the lowering actuation parts are replaced by a vertical mechanical, hydraulic, or pneumatic lowering device instead of the angled operation of the various most preferred embodiments. In general, the term "front" refers to parts disposed towards the cab or front of the ambulance, and the term "rear" refers to parts disposed towards the back of the ambulance.

In more detail, the deployable gurney ramp assembly 12 is useful for lifting a gurney G with an undercarriage including wheels and an apparatus for raising and lowering the gurney. A retractable ramp deployment apparatus 14 has opposing first and second deployment tracks 16 and 18 which extend parallel from front ends 20 to rear ends 22. Parallel first and second base tracks 24 and 26 have front and rear ends 28 and 30, the rear ends 30 terminating in stops 32. The deployment tracks 16 and 18 are configured to slidably engage the base tracks 24 and 26. The front ends 20 and 22 of the deployment tracks 16 and 18 have slidable axial rotating device 34 (such as, an axial radial bearing, which has an axial bearing for slidably engaging a track, and a radial bearing which catches at the stop to allow lowering of the ramp guides.) pivotally retained in the base tracks 24 and 26 by the stops 32.

A ramp guide 15 or two ramp guides 15 and 17 are slidably engaged along the length of the deployment tracks 16 and 18 having rear ends 19 pivotally engaging a ramp 36 permitting the ramp 36 to pivot when raised or lowered. The ramp 36 has a floor 38, two sides 40 and 42 with the two pivot attachments 44 disposed opposite one another on each side 40 and 42 of the ramp 36, and an unobstructed entryway 46 at the ramp's rear 48 to accommodate the gurney. A cross bar 50 is rigidly disposed between the first and second deployment tracks 16 and 18 at or near to the front end 20 thereof forming a single rigid structure.

A first retraction apparatus 53 for slidably moving the retractable ramp deployment apparatus 14 along the length of the base tracks. A second retraction apparatus 55 for slidably moving the ramp guides 15 and 17 along the length of the deployment tracks 16 and 18. Lift actuators 52 are used for lifting and lowering the ramp 36.

The lift actuators 52 comprise at least two lowering, lifting apparatuses fixed at the rear end to the cross bar and engaged along an axle thereto. Alternative, lift actuators 52 are taken from the group consisting of a telescoping ram 54 or vertical lifting column 56. The lift apparatus 52 in an embodiment comprises at least three telescoping cylindrical rams 68. A cantilevered arm 70 composed of two lengths of metal (or rods) 72 and 74 hengedly attaches adjacent the telescoping cylindrical rams 68.

The first retraction apparatus 53 comprises a first screw 60 disposed adjacent and along the length of a base track. The first screw is rotatably engaged in a motor disposed adjacent the front end of the base track and a slider piece attached to the deployment apparatus. The slider component moves along the length of the screw to move the deployment apparatus along a horizontal stroke.

The second retraction apparatus 55, in an alternative embodiment, is a second screw 61 disposed adjacent to one of the deployment tracks. The second screw rotatably engages in a motor disposed adjacent the front end of the deployment tracks such that the second screw moves along with the deployment tracks. The rear end of the deployment track culminates in a slidable axial rotating device 35. The second screw is engaged along the distance of the first opposing track through a threaded cuff 68 attached to the ramp. When the motor rotates the screw, the screw turns in the threaded cuff to move along the first opposing track thereby retracting and extending the retractable ramp deployment apparatus. The second retraction apparatus 55 comprises a screw mechanism affixed towards the front end of the deployment tracks and engaged in a threaded cuff, which is disposed in a cuff guide disposed on the ramp guide.

A guide rod 62, which serves as a leveling device maintinating the horizontal plane at any position of the ramp, has front and rear ends 64 and 66 disposed adjacent a deployment track extending the length thereof. Rotatable attachments 70 are disposed at both ends thereof. The rear end is rotatably attached to the retractable ramp adjacent the pivot attachment, and the front end is rotatably attached adjacent the base track. The guide rod 62 operates to substantially maintain the ramp in a horizontal position.

The floor 38 of the ramp 36 may have a lift mechanism 58 extending upwards from the floor 38 of the ramp 36 to engage, control, and lower the gurney G. An electric, pneumatic, or hydraulic actuator is operable to engage a lowering mechanism in the gurney. Locking retainers 24 are positioned to extend upward from the floor 16 of the ramp adjacent the gurney's undercarriage wherein the retainers 24 lock the gurney into position using mechanical or electromagnetic actuation. A containment cover 73 disposed over the deployable gurney ramp 36 at the front with the ramp 36 serving to cover the remainder of the operations under the ramp 36 and containment cover 73 when in fully retracted position.

Power is provided by pneumatic, electrical alternating current and direct current, engine gas or diesel to produce direct current, engine (gas or diesel) to produce direct to an inverter to convert to alternating current. Movement is effectuated by hydraulic cylinders, hydraulic rams, pump pressure through control, pneumatic actuation (increase air pressure), hydraulic actuation (increase fluid pressure), mechanical movement including screw actuation, dampening pressure cylinder (such as a CO2 cylinder), sprocket and chain, belt and pulley, gear and track, or combinations thereof.

Optionally actuators which may be used include rams which are actuated mechanically (through motor turning screw or self-contained hydraulic unit) or pneumatically (air works same as hydraulics in that the seal increases pressure) or hydraulically (fluid pressure increases).

It is to be understood that the present invention is not limited to the embodiments described above, but encompasses any and all embodiments within the scope of the following claims.

What is claimed is:

1. A deployable gurney ramp assembly for lifting a gurney with an undercarriage including wheels and an apparatus for raising and lowering the gurney, comprising:

a retractable ramp deployment apparatus having opposing first and second deployment tracks extending parallel from front ends to rear ends;

parallel first and second base tracks having front and rear ends, the rear ends terminating in stops;

the deployment tracks configured to slidably engage the base tracks;

the front ends of the deployment tracks have slidable axial rotating device pivotally retained in the base tracks by the stops;

at least one ramp guide slidably engaged along the length of the deployment tracks having rear ends pivotally engaging a ramp permitting the ramp to pivot when raised or lowered;

the ramp having a floor, two sides with the two pivot attachments disposed opposite one another on each side of the ramp, an unobstructed entryway at the ramp's rear to accommodate the gurney;

a cross bar rigidly disposed between the first and second deployment tracks and at or near to the front end thereof forming a single rigid structure;

a first retraction apparatus for slidably moving the retractable ramp deployment apparatus along the length of the base tracks;

a second retraction apparatus for slidably moving the ramp guides along the length of the deployment tracks; and lift actuators for lifting and lowering the ramp; wherein, the lift actuators comprise at least three telescoping cylindrical rams.

2. The deployable gurney ramp assembly of claim 1, wherein:

the lift actuators comprise at least two lowering, lifting apparatuses fixed at the rear end to the cross bar and engaged along an axle thereto.

3. The deployable gurney ramp assembly of claim 2, wherein:

the lift actuators are taken from the group consisting of a telescoping ram or vertical lifting column.

4. The deployable gurney ramp assembly of claim 1, wherein:

the first retraction apparatus comprises a first screw disposed adjacent and along the length of a base track, the first screw rotatably engaged in a motor disposed adjacent the front end of the base track and a slider piece attached to the deployment apparatus, which slider component moves along the length of the screw to move the deployment apparatus along a horizontal stroke.

5. The deployable gurney ramp assembly of claim 1, wherein:

the second retraction apparatus comprises a second screw disposed adjacent to one of the deployment tracks, the second screw rotatably engaged in a motor disposed adjacent the front end of the deployment tracks such that the second screw moves along with the deployment tracks, the rear end of the deployment track culminates in a slidable axial rotating device, while the screw is engaged along the distance of the first opposing track through a threaded cuff attached to the ramp such that when the motor rotates the screw to turn in the threaded cuff to move along the first opposing track thereby retracting and extending the retractable ramp deployment apparatus.

6. The deployable gurney ramp assembly of claim 1, further comprising:

a guide rod having front and rear ends disposed adjacent a deployment track extending the length thereof, with rotatable attachment disposed at both ends thereof, with the rear end rotatably attached to the retractable ramp adjacent the pivot attachment, and front end rotatably attached adjacent the base track.

7. The deployable gurney ramp assembly of claim 1, further comprising:

a cantilevered arm composed of two lengths of metal hengedly attached adjacent the telescoping cylindrical rams.

8. The deployable gurney ramp assembly of claim 1, wherein: the second retraction apparatus comprises a screw mechanism affixed towards the front end of the deployment tracks and engaged in a threaded cuff disposed in a cuff guide disposed on the ramp guide.

9. The deployable gurney ramp assembly of claim 1, further comprising:

a lift mechanism extending from the floor of the ramp to engage, control, and lower the gurney.

10. The deployable gurney ramp assembly of claim 9, further comprising:

an electric, pneumatic, or hydraulic actuator operable to engage a lowering mechanism in the gurney.

11. The deployable gurney ramp assembly of claim 1, further comprising:

locking retainers positioned to extend upward from the floor adjacent the gurney's undercarriage wherein the retainers lock the gurney into position using mechanical or electromagnetic actuation.

12. The deployable gurney ramp assembly of claim 1, further comprising:

a containment cover disposed over the deployable gurney ramp at the front ends of the base tracks.

13. The deployable gurney ramp assembly of claim 1, wherein: power is provided by pneumatic, electrical alternating current and direct current, engine gas or diesel.

14. The deployable gurney ramp assembly of claim 1, wherein: movement is effectuated by hydraulic cylinders, hydraulic rams, pump pressure through control, pneumatic actuation, hydraulic actuation, mechanical movement, screw actuation, dampening pressure cylinder, sprocket and chain, belt and pulley, or gear and track, or combinations thereof.

15. The deployable gurney ramp assembly of claim 1, wherein:

rams actuated mechanically, pneumatically, hydraulically, or combinations thereof.

16. A deployable gurney ramp assembly for lifting a gurney with an undercarriage including wheels and an apparatus for raising and lowering the gurney, comprising:

a retractable ramp deployment apparatus having opposing first and second deployment tracks extending parallel from front ends to rear ends;

parallel first and second base tracks having front and rear ends, the rear ends terminating in stops;

the deployment tracks configured to slidably engage the base tracks;

the front ends of the deployment tracks have slidable axial rotating device pivotally retained in the base tracks by the stops;

ramp guides slidably engaged along the length of the deployment tracks having rear ends pivotally engaging a ramp permitting the ramp to pivot when raised or lowered;

the ramp having a floor, two sides with the two pivot attachments disposed opposite one another on each side of the ramp, an unobstructed entryway at the ramp's rear to accommodate the gurney;

a cross bar rigidly disposed between the first and second deployment tracks at or near to the front end thereof forming a single rigid structure;

a first retraction apparatus for slidably moving the retractable ramp deployment apparatus along the length of the base tracks;

a second retraction apparatus for slidably moving the ramp guides along the length of the deployment tracks; and lift actuators for lifting and lowering the ramp wherein the lift actuators comprise at least three telescoping cylindrical rams.

17. The deployable gurney ramp assembly of claim 16, wherein:

the first retraction apparatus comprises a first screw disposed adjacent and along the length of a base track, the first screw rotatably engaged in a motor disposed adjacent the front end of the base track and a slider piece attached to the deployment apparatus, which slider component moves along the length of the screw to move the deployment apparatus along a horizontal stroke.

18. The deployable gurney ramp assembly of claim 16, wherein:

the second retraction apparatus comprises a second screw disposed adjacent to one of the deployment tracks, the second screw rotatably engaged in a motor disposed adjacent the front end of the deployment tracks such that the second screw moves along with the deployment tracks, the rear end of the deployment track culminates in a slidable axial rotating device, while the screw is engaged along the distance of the first opposing track through a threaded cuff attached to the ramp such that when the motor rotates the screw to turn in the threaded cuff to move along the first opposing track thereby retracting and extending the retractable ramp deployment apparatus.

19. The deployable gurney ramp assembly of claim 16, further comprising:

a guide rod having front and rear ends disposed adjacent a deployment track extending the length thereof, with rotatable attachment disposed at both ends thereof, with the rear end rotatably attached to the retractable ramp adjacent the pivot attachment, and front end rotatably attached adjacent the base track.

20. The deployable gurney ramp assembly of claim 16, further comprising:

an electric, pneumatic, or hydraulic actuator operable to engage a lowering mechanism in the gurney.

* * * * *